US005224892A

United States Patent [19]

Messina

[11] Patent Number: 5,224,892

[45] Date of Patent: Jul. 6, 1993

[54] BUBBLE MAKER

[76] Inventor: Gene A. Messina, 22 William Penn Dr., Stonybrook, N.Y. 11790

[21] Appl. No.: 769,333

[22] Filed: Oct. 1, 1991

Related U.S. Application Data

[63] Continuation of Ser. No. 696,049, May 6, 1991, abandoned.

[51] Int. Cl.[5] ..... A63H 33/28

[52] U.S. Cl. ..... 446/15

[58] Field of Search ..... 446/15-21

[56] References Cited

U.S. PATENT DOCUMENTS

| | | | |
|---|---|---|---|
| 2,391,797 | 12/1945 | Raspet | 446/21 |
| 2,587,895 | 3/1952 | Quinn, Jr. et al. | 446/20 |
| 2,606,395 | 8/1952 | Fulton | 446/15 |
| 2,741,068 | 4/1956 | Hollis | 446/20 |
| 4,654,017 | 3/1987 | Stein | 446/15 |
| 4,790,787 | 12/1988 | Rector | 446/15 |
| 4,808,138 | 2/1989 | Von Braunhut | 446/16 |
| 4,943,255 | 7/1990 | Klundt | 446/15 |

FOREIGN PATENT DOCUMENTS

| | | | |
|---|---|---|---|
| 1207282 | 9/1970 | United Kingdom | 446/15 |

OTHER PUBLICATIONS

"Ephemeral Sculpture Machine", Felix Cartagena, 1986.

"The Unbelieveable Bubble Book" by John Cassidy (1987) pp. 11 and 12., Klutz Press, Palo Alto, Calif.

*Primary Examiner*—Mickey Yu

*Attorney, Agent, or Firm*—J. Robert Cassidy

[57] ABSTRACT

A bubble maker including a support and a pair of separate bands connected to the support at first and second spaced-apart positions. The bands are adapted to extend substantially parallel and near to each other and also to be flexed and stretched so as to form a gap of substantial size between the bands. A dispenser mounted on the support dispenses a bubble-forming solution near the first position, and a collector mounted on the support collects excess solution near the second position. Drawstrings mounted on the support engage the elastic bands at positions intermediate the first and second positions for separating the bands. A pump pumps solution from the collector to the dispenser. Accordingly, when the support is oriented with the first position above the second and solution is dispensed onto the bands, the bands are separated by the drawstrings, and a gentle air current is established relative to the bubble maker so that air passes between the separated bands, a portion of the solution forms a bubble and excess solution flows down to and is collected by the collector, from which it can be recirculated to the dispenser by the pump.

21 Claims, 4 Drawing Sheets

BUBBLE MAKER

This is a continuation of application Ser. No. 06/896,049, filed May 6, 1991 abandoned.

BACKGROUND OF THE INVENTION

1. Field of the Invention

This invention relates to bubble makers and more particularly to a novel and highly effective bubble maker that is capable of consistently making giant bubbles while producing little mess and being very economical in the use of bubble-forming solution.

2. Description of the Prior Art

Apparatus for making large soap bubbles is known. A patent to Stein No. 4,654,017 discloses such apparatus comprising a bubble-forming loop made of a flexible, large pore, substantially non-capillary material able to store large quantities of a bubble solution by adhesion to a large surface area. A rod supports the bubble-forming loop, and a slide controllably opens and closes the bubble-forming loop. A reservoir is provided for maximizing continuity of the supply of solution to the bubble-forming loop.

A patent to Rector U.S. Pat. No. 4,790,787 discloses a pallet for holding a bubble-making fluid and a bubble maker with a plurality of user-controlled bow members. The bow members are curved and pivotally attached to each other at upper ends and lower ends and have protruding handgrips at the lower ends on their concave sides. Each bow member may include a supply system to wick and hold a supply of bubble-making fluid. In operation, a user of the apparatus draws the bow members through the bubble-making fluid held by the pellet. Then, while waving the bows through the air or projecting the bows into the wind, the user pivots the bow members with the handgrips to produce an opening of variable size between the bows to form a bubble between the bows.

A patent to Klundt U.S. Pat. No. 4,943,255 discloses bubble-making apparatus including a continuous three-segment flexible wick for storing and releasing quantities of a bubble solution. One segment is equal in length to the combined length of the other two segments. A control wand is secured to the wick between adjacent portions of the second and third segments. A support wand is secured to the wick between adjacent portions of the first and second segments to control the formation and size of a bubble formed from the bubble solution. A weight is fixed to the wick at a point between the first and third segments.

In addition, apparatus is known comprising a tube and a fabric loop attached to the tube at two places. A weight is attached to a long portion of the loop so that it hangs down and forms an opening in which a bubble can be formed. One point of attachment of the loop to the tube is slidable along the tube to control the size of the opening.

A number of problems are associated with bubble makers of the prior art that render them less than ideal playthings. One problem is that conventional bubble makers are inherently messy. When bubble-forming solution is dispensed onto the bands or other members that are employed to form the bubbles, excess solution tends to run or drip onto the hands and clothing of a person using the apparatus and onto the floor, patio or ground. This is wasteful of bubble-forming solution and it generally creates a mess that is difficult to clean up.

Bubble-forming solution is typically fairly viscous and has the consistency of a rich soap solution, often with glycerine added. A relatively large volume of water is required to rinse the solution from clothing, furniture, floors, etc., which makes cleanup a messy process.

The problem of cleanup is exacerbated when the bubbles to be formed are of extroardinary size, since the amount of solution employed is correspondingly large. Moreover, the better the bubble maker words, the longer it is likely to be played with by a user of the bubble maker and hence the greater the mess that is likely to be created.

Another problem of conventional bubble makers, even those intended to make giant bubbles, is that they do not consistently perform as intended. In order to make giant bubbles consistently, it is necessary to employ apparatus that enables very precise control of the dispensing of bubble-forming solution onto the bands or other bubble-forming members, since the bubble-forming members, even if perforated or otherwise configured to enlarge their surface area, have a limited storage capacity. Unless the bubble-forming solution initially stored in the bubble-forming members is replenished during bubble formation, the solution is quickly used up as the bubble begins to form, thus limiting the size of the bubble. Moreover, in order to make giant bubbles consistently, it is necessary to employ apparatus that enables very precise control of the rate of separation of the bubble-forming members and of their geometry. Conventional bubble makers do not provide for optimum precision in these respects.

Another problem of conventional bubble makers is that the number of bubbles that can be made from a given supply of bubble-forming solution is limited so that a large amount of bubble-forming solution must be provided to enable an extended period of play. This makes what should ideally be an inexpensive pastime for children and others a not-so-inexpensive pastime. It also makes the transport of the requisite volume of bubble-forming solution (from store to house, from house to field, etc.) a rather cumbersome procedure.

OBJECTS AND SUMMARY OF THE INVENTION

An object of the invention is to remedy the problems of the prior art noted above. In particular, an object of the invention is to provide a bubble maker that is capable of consistently making giant bubbles. Another object of the invention is to provide a bubble maker that conserves bubble-making solution and produces little mess during its operation. Another object of the invention is to provide a bubble maker that is more economical to use than conventional bubble makers that are capable of making large bubbles. Another object of the invention is to provide a bubble maker capable of making larger bubbles than prior apparatus, and which is inexpensive to manufacture and easy to operate.

The foregoing and other objects are achieved in accordance with the invention by the provision of a bubble maker comprising support means, a pair of separate bands connected to the support means at first and second spaced-apart positions, the bands being adapted to extend substantially parallel and near to each other and at least one of the bands being adapted to e flexed so as to form a gap of substantial size between the bands. Dispensing means mounted on the support means dispenses bubble-forming solution near the first position, and collection means mounted on the support means collects excess solution near the second position. Separating means mounted on the support means is engageable with at least the flexible band at a position intermediate the first and second positions for separating the bands. Pump means pumps solution from the collecting means to the dispensing means. Thus when (a) the support means is oriented with the first position at an elevation substantially greater than that of the second position, (b) solution is dispensed onto the bands, (c) the bands are separated by the separating means, and (d) a gentle air current is established relative to the bubble maker so that air passes between the separated bands, a portion of the solution forms a bubble and excess solution flows down to and and is collected by the collection means, from which it can be recirculated to the dispensing means by the pump means.

In accordance with an independent aspect of the invention, there is provided a bubble maker comprising support means; a pair of separate flexible and elastic bands connected to the support means at first and second spaced apart positions, the bands being adapted to extend substantially parallel and near to each other and being adapted to be flexed and stretched so as to form a gap of substantial size between the bands; means for applying bubble-forming solution to the bands; and separating means mounted on the support means and engageable with the flexible bands at positions intermediate the first and second positions for separating the bands; whereby when solution is dispensed onto the bands, the bands are separated by the separating means, and a gentle air current is established relative to the bubble maker so that air passes between the separated bands, the solution forms a bubble.

BRIEF DESCRIPTION OF THE DRAWING

A better understanding of the objects, features and advantages of the invention can be gained from a consideration of the following detailed description of the preferred embodiments thereof, in conjunction with the appended figures of the drawing, wherein a given reference character always refers to the same element or part and wherein.

DESCRIPTION OF THE PREFERRED EMBODIMENTS

Figure 1:
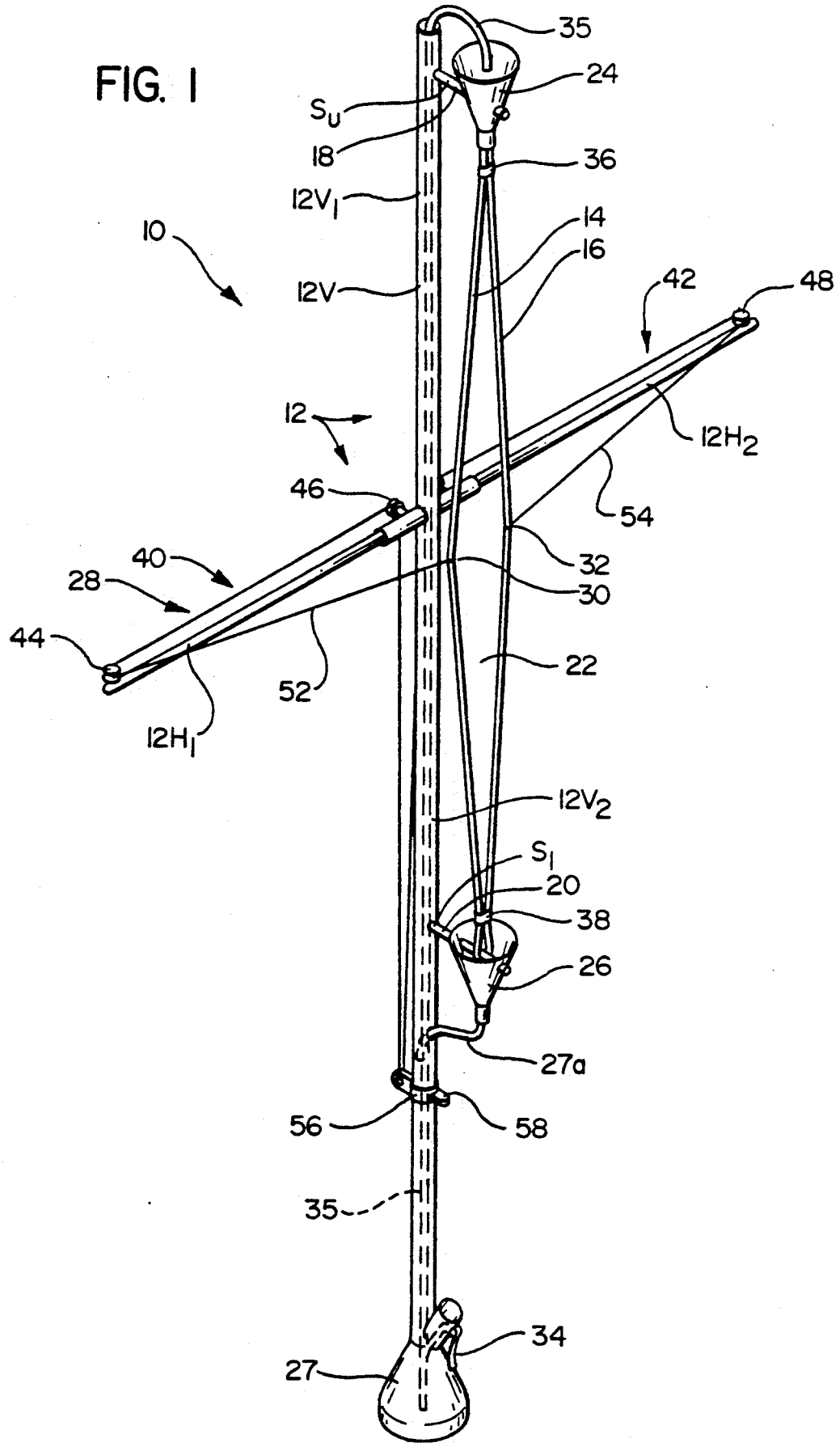
FIG. 1 is a perspective view of a first preferred embodiment of the invention.
Figure 2:
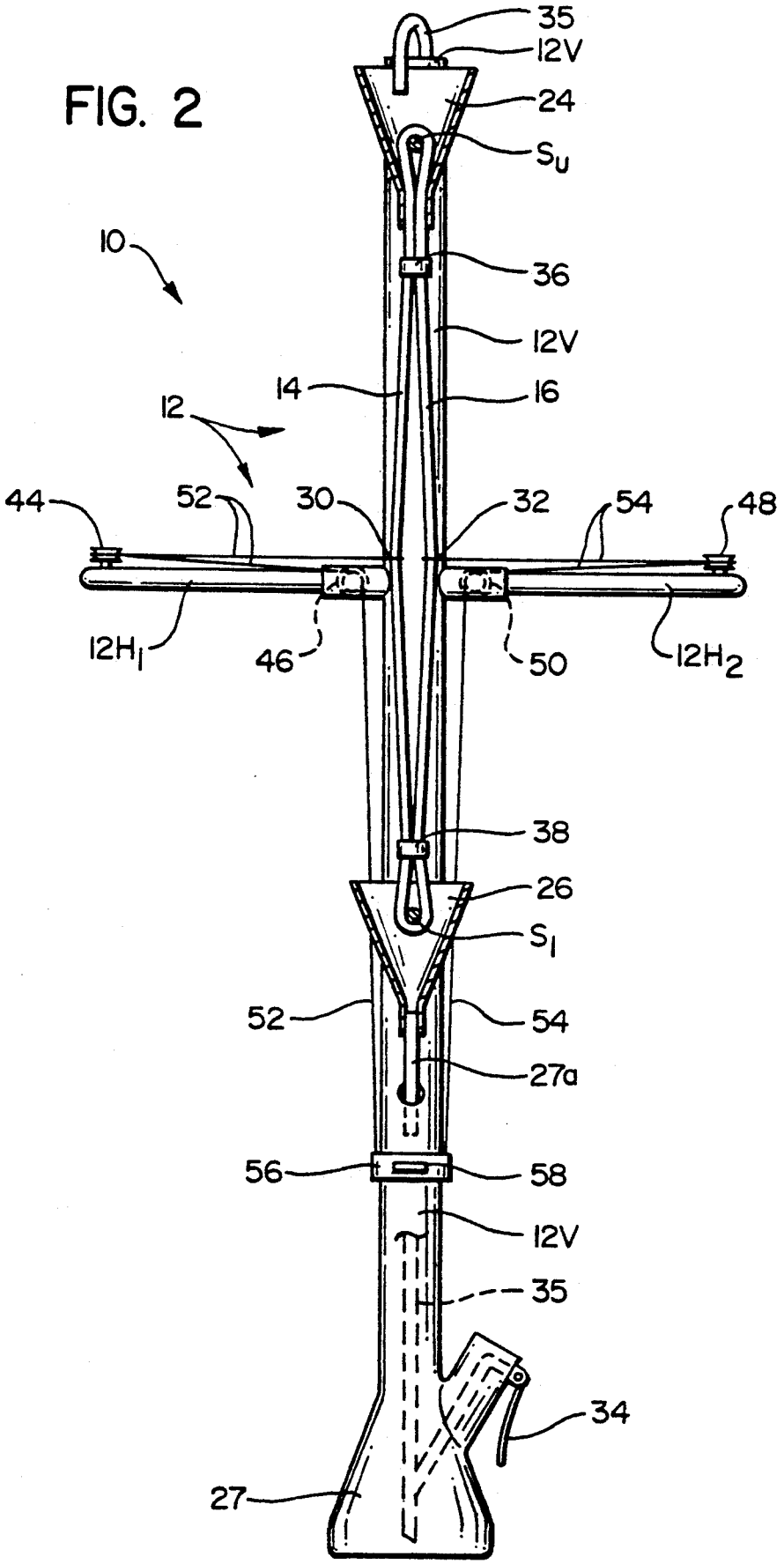
FIG. 2 is a diagrammatic view, not to scale, showing more clearly certain features of the apparatus of FIG. 1 and helpful in understanding the principle of its operation.
Figure 3:
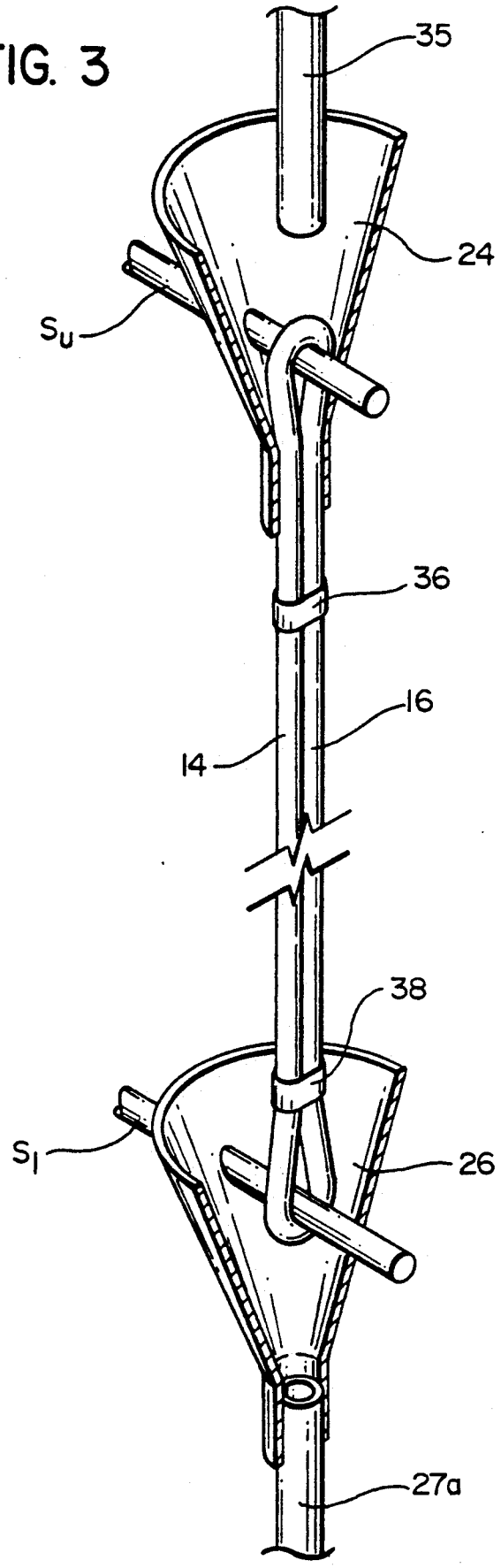
FIG. 3 is a perspective view on a larger scale of a portion of the apparatus of FIG. 1.

FIGS. 1-3 show a first preferred embodiment of a bubble maker 10 constructed in accordance with the invention. It can easily and inexpensively be constructed in a size that enables it to make soap bubbles much larger than a person. The bubble maker 10 comprises support means 12 and a pair of separate bands 14 and 16 connected to the support means 12 at first and second spaced apart positions 18 and 20. The bands 14 and 16 are adapted to extend substantially parallel and near to each other, preferably touching each other at least at intervals, and at least one and preferably both of the bands 14 and 16 are adapted to be flexed so as to form an adjustable gap 22 that can grow to substantial size between the bands 14 and 16. Preferably the bands 14 and 16 are not only flexible but also elastic so that they stretch as they are separated and encompass an area larger than that which they would encompass if not elastic.

Dispensing means in the form of a funnel 24 is mounted on the support means 12 near the first position 18 for dispensing bubble-forming solution near the first position 18. The funnel 24 is connected by epoxy resin or in any other suitable manner to an upper spar $S_U$ adjacent to the position 18. Collection means 26 in the form of a funnel 26 and reservoir 27 connected by a drain line 27a is mounted on the support means 12 for collecting excess solution near the second position 20. The funnel 26 is connected by epoxy resin or any other suitable manner to a lower spar $S_l$ adjacent to the position 20. The upper and lower spar $S_U$ and $S_l$ are rigidly connected to and extend horizontally from the vertical member 12V.

Separating means 28 including drawstrings 52 and 54 and other elements described below is mounted on the support means 12 and engageable with at least one and preferably both of the flexible bands 14 and 16 at positions 30 and 32 intermediate the first and second positions 18 and 20 for separating the bands 14 and 16. Pump means 34 in the form of a hand-powered pump 34 extends into the reservoir 27 and pumps the bubble-forming solution from the collector 26, 27 to the dispenser 24 via a pump line 35.

Thus, when the support 12 is oriented with the first position 18 at an elevation substantially greater than that of the second position 20, bubble-forming solution is dispensed onto the bands 14 and 16, the bands 14 and 16 are separated by the separating means 28 including the drawstrings 52, 54, and a gentle air current is established relative to the bubble maker so that air passes between the separated bands 14 and 16, a portion of the solution forms a bubble and excess solution flows down to and is collected by the collector 26, 27 from which it can be recirculated to the dispenser 24 by the pump 34 via the pump line 35 that preferably extends through the vertical member 12V.

An indicated above, each of the bands 14 and 16 is preferably both flexible and elastic, and the separating device 28 is engageable with both of the bands 14 and 16 at respective positions 30 and 32 intermediate the first and second positions 18 and 20 for separating the bands 14 and 16.

In the preferred embodiment of the invention, since the bands 14 and 16 are elastic and stretch when the separator 28 separates them, the area of the gap 22 can be made quite large. The bands 14 and 16 may be made of rubber, surgical tubing, fabric-covered elastic, or any other suitable material that is adapted to contain a substantial quantity of bubble-forming solution and to flex or preferably stretch and flex in order to form the gap 22.

In a preferred embodiment of the invention, each of the bands 14 and 16 comprises a pair of side-by-side strands. For example, each band 14 and 16 can be made of a rubber band, surgical tube, or fabric-covered elastic that is twisted longitudinally. If surgical tubing is employed, bubble-forming solution can be carried both inside and outside the tubing. In addition, the strands can be perforated, and each strand of each band can be joined to the other strand of the same band at intervals. This facilitates the retention of bubble-forming solution so that a greater quantity of solution can be made initially available to form a bubble. While each of the bands 14 and 16 may comprise strands that are twisted about or joined at intervals to, the other strands of the same band 14 or 16, the bands 14 and 16 are preferably not twisted about, or joined to each other (except possibly at their top and bottom ends), since this would interfere to a degree with the desired separation of the bands to form the gap 22.

A pair of inelastic retainers 36 and 38 best shown in FIG. 3 are affixed to the bands 14 and 16 respectively near the first and second positions 18 and 20 for preventing the bands 14 and 16 from separating from each other at the first and second positions 18 and 20. The retains 36 and 38 thereby ensure that the bands 14 and 16 form a closed loop and facilitate entry of the bands 14 and 16 into the dispenser 24 and the funnel 26 of the collector 26, 27.

In FIG. 1, the support 12 is in the shape of a cross having a vertical member 12V and a pair of arms or horizontal members $12H_1$ and $12H_2$. The arms $12H_1$ and $12H_2$ can be physically one piece or separate pieces each connected to the vertical member 12V. If they are separate pieces, disassembly of the apparatus for shipping and storage is facilitated. Similarly, the vertical member 12V can be one or more pieces. The arms $12H_1$ and $12H_2$ intersect the vertical member 12V substantially at the mid-portion of the vertical member 12V, and the vertical member 12V, including portions $12V_1$ and $12V_2$, intersects the arms substantially at the mid-portion thereof. In other words, the arms $12H_1$ and $12H_2$ are preferably of equal length, and the portions $12V_1$ and $12V_2$ are preferably also of equal length.

The separator 28 comprises a pair of pulley means 40 and 42. The pulley means 40 includes pulleys 44 and 46, and the pulley means 42 includes pulleys 48 and 50. At least the pulleys 44 and 48 are connected to the arms $12H_1$ and $12H_2$ in spaced-apart relation to the elastic bands 14 and 16. The pair of drawstrings 52 and 54 have first ends engageable with the respective elastic bands 14 and 16 substantially at the mid-portions 30 and 32 thereof. The drawingstrings 52 and 54 pass respectively around the pulleys 44 and 46 and around the pulleys 48 and 50. The drawstrings 52 and 54 have second ends that are joined together, for example by their connection to a ring 56 that is slidable by means of a projecting handle 58 along the lower end of the vertical member 12V. When the ring 56 is pulled down in FIG. 1, the drawingstrings 52 and 54 are pulled around the pulleys 46, 44 and the pulleys 50, 48 so that the elastic bands 14 and 16 are separated at the points 30 and 32 to form the gap 22. The gap 22 tapers from the points 30 and 32 in either direction toward the retainers 36 and 38.

Figure 4:
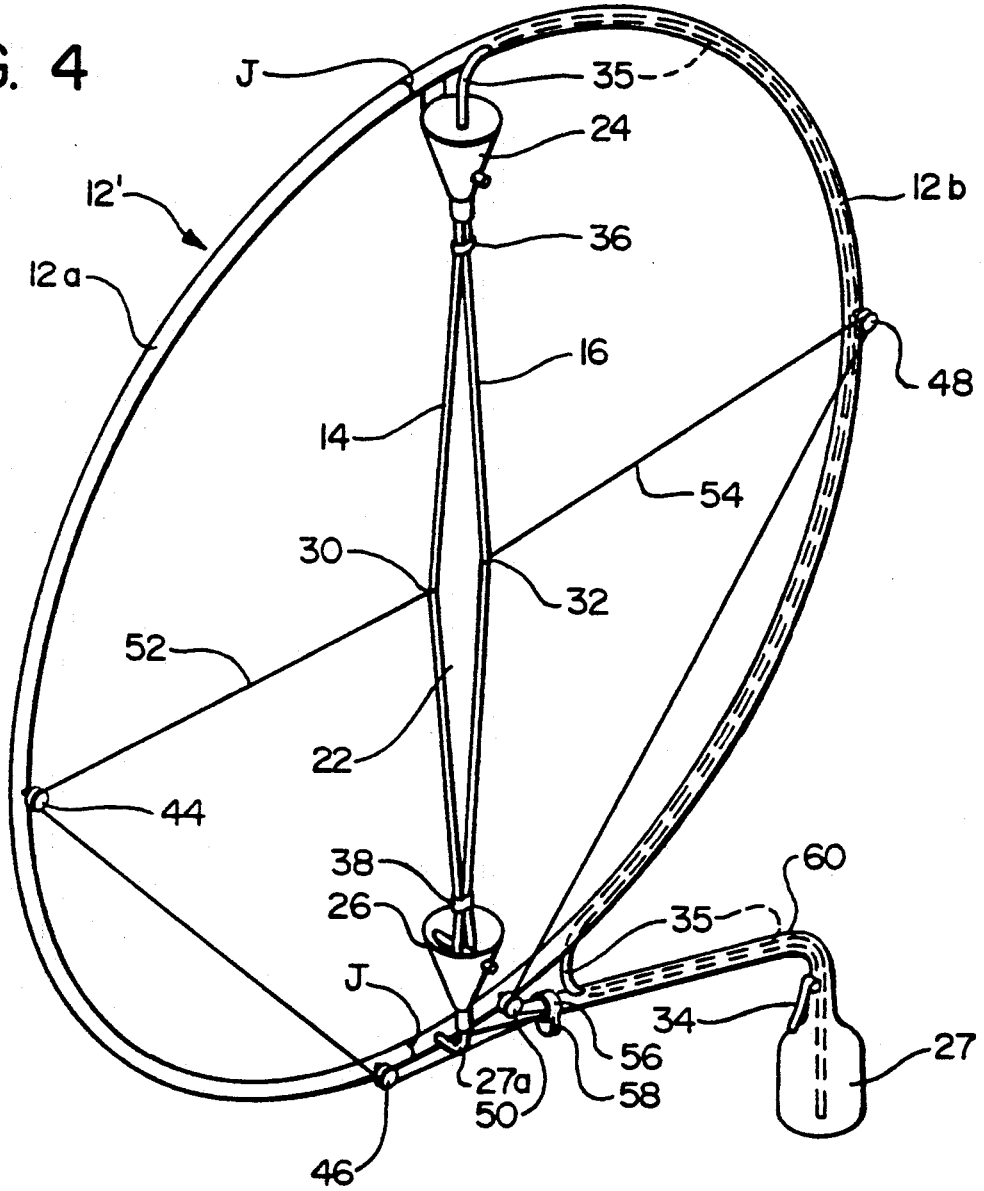
FIG. 4 is a perspective view of a second preferred embodiment of the invention.

The cruciform support 12 in the apparatus of FIG. 1 is replaced in the apparatus of FIG. 4 by a support 12' in the form of a loop. The loop is preferably circular, although it can be oval, square or otherwise multilateral or have some other shape. The dispenser 24 and the collector **26, 27*a*, 27 are mounted on the support so that the dispenser 24 is normally at a higher elevation than the collector 26, 27*a*, 27. The drawstrings 52 and 54 are attached to midpoints 30 and 32 of the flexible, elastic bands 14 and 16. The pulleys 44 and 48 are placed on the circumference of the loop at an angular distance of about 90° from both the dispenser funnel 24 and the collector funnel 26. The pulleys 46 and 50 are placed adjacent to the collector funnel 26. The ring 56 is provided with a handle 58 that enables the ring to be moved slidably along an extension 60 of the support 12'. The reservoir 27 collects bubble-forming solution from the collector funnel 26 via the drain line 27*a*, as in the embodiment of FIGS. 1–3. The pump 34 pumps the solution from the reservoir 27 through a pump line 35 which preferably extends through one arm of the loop 12' and empties into the dispenser funnel 24**.

As in the embodiment of FIGS. 1–3, the pump 34 in FIG. 4 preferably comprises a hand-powered device inserted into the reservoir 27 the pump line 35 extending through the support from the pump 34 to the dispensing funnel 24 for returning to the dispensing funnel 24 the bubble-forming solution pumped by the pump 34.

Thus there is provided in accordance with the invention a novel and highly-effective bubble maker capable of making giant bubbles. The pump 34 is easily activated by hand to force the bubble-forming solution through the pump line 35 to the dispensing funnel 24. The bubble-forming solution flows or trickles down the elastic bands 14 and 16 by gravity, coating the bands so that they can form the skin of the bubble. Excess solution flows down the bands 14 and 16 and is connected in the lower funnel 26 and returned to the reservoir 27 to be reused. The ring 56 is pulled down by means of the handle 58. This exerts a pull on the drawstrings 52 and 54 simultaneously. The drawstrings 52 and 54 separate the elastic bands 14 and 16, thereby forming the skin of the bubble. The user of the bubble maker walks slowly into the wind or holds the bubble maker in a gentle breeze. In either case, a relative wind velocity is formed with respect to the bubble maker, and a bubble is formed. During formation of the bubble, as the solution initially stored in or on the bands 14 and 16 is consumed, the pump 34 is employed to recharge the dispenser funnel 24, so that dditional solution is dispensed onto the bands 14 and 16, thereby substantially increasing the size of the bubble that can be formed. When the bubble reaches its desired size, the slidable ring 56 is moved up to its original position by means of the handle 58. This allows the elastic bands 14 and 16 to return to their original side-by-side positions, which causes the bubble to close off and become detached.

Clearly, in proportion to the size of the bubbles formed, very little mess results from the bubble-forming solution, since the solution is recycled. The number of bubbles of a given size that can be made from a given quantity of solution is many times greater than the number that can be made by conventional bubble makers, in which the solution is not recirculated.

Extremely large bubbles can be made, on a consistent basis, by pumping slowly during the bubble-making process to feed additional solution onto the elastic bands 14 and 16.

Of course, the bubble maker of the invention, while adapted to make gain bubbles, is not limited to any particular size. It can be made small for young children, larger for older children, and larger still for adults.

Most parts of the apparatus can be made of plastic, which are inexpensive, will not corrode, and can easily be rinsed clean after each use.

An additional set of bands can be employed to form a bubble within a bubble.

The apparatus can be made with male and female parts for easy assembly, disassembly, storage, and shipping. Telescoping members can be utilized for making a compact product.

In the embodiment of FIG. 4, the loop can be made of a plurality of arcuate portions such as two half-circles **12'*a* and 12'*b* joined for example by telescoping portions at junctions J. The telescoping portion can be short so that the curvature does not cause them to bind, or the curvature can be flattened. In either case, pins (not shown) can be provided to prevent inadvertent detachment of the half-circle 12'a and 12'b** during use. Similarly, the loop can be made of four arcs of about 90° each, six arcs of about 60° each, etc., that can be assembled for use or disassembled to facilitate shipping and storage.

Instead of the sliding ring and handle 56, 58, a trigger assembly or pump lever can be located on the reservoir and used to open and close the elastic bands 14 and 16. In the embodiment of FIG. 4, additional pulleys and drawstrings may be added to increase the area of the gap 22 that can be formed within the circle. This increased area allows a still larger bubble to be made. The circular support 12' of FIG. 4 eliminates the vertical and horizontal members, making it safer and stronger for use by children. Also, the apparatus of FIG. 4 can be operated equally well left-handed or right-handed, since a bubble can form in either direction (into or out of the plane of FIG. 4) without interference from the support 12'.

Although as indicated above the pump is preferably hand-powered for economy of construction, it is within the scope of the invention to employ a pump that is powered electrically. It is also within the scope of the invention to employ an electric fan to establish the relative wind for making bubbles, especially in an indoor environment.

Many other embodiments of the invention will occur to those skilled in the art upon consideration of this disclosure. All such embodiments are intended to be covered. Accordingly, the invention is not limited except by the appended claims.

I claim:

1. A bubble maker comprising:

support means;

a pair of separate bands connected to the support means at first and second spaced-apart positions, the bands being adapted to extend substantially parallel and near to each other and at least one of the bands is a flexible band and is adapted to be flexed so as to form a gap of substantial size between the bands;

dispensing means mounted on the support means for dispensing bubble-forming solution near the first position;

collection means mounted on the support means for collecting excess solution near the second position;

separating means mounted on the support means and engageable with at least the flexible band at a position intermediate the first and second positions for separating the bands; and pump means for pumping solution from the collection means to the dispensing means;

whereby when (a) the support means is oriented with the first position at an elevation substantially greater than that of the second position, (b) solution is dispensed onto the bands by the dispensing means, (c) the bands are separated by the separating means, and (d) a gentle air current is established relative to the bubble maker so that air passes between the separated bands, a portion of the solution forms a bubble and excess solution flows down to and is collected by the collection means, from which it can be recirculated to the dispensing means by the pump means.

2. A bubble maker according to claim 1 wherein both of the bands are flexible and touch each other at least at intervals and the separating means is engageable with both of the flexible bands at positions intermediate the first and second positions for separating the bands.

3. A bubble maker according to claim 1 wherein the flexible band is elastic and stretches when the separating means separates the bands.

4. A bubble maker according to claim 1 wherein the flexible band is elastic and made of rubber.

5. A bubble maker according to claim 1 wherein the flexible band is elastic and made of surgical tubing.

6. A bubble maker according to claim 1 wherein the flexible band is elastic and made of fabric-covered elastic.

7. A bubble maker according to claim 1 wherein both of the bands are flexible and elastic and stretch when the separating means separates the bands.

8. A bubble maker according to claim 1 wherein both of the bands are flexible and elastic and stretch when the separating means separates the bands and both of the bands are made of rubber.

9. A bubble maker according to claim 1 wherein both of the bands are flexible and elastic and stretch when the separating means separates the bands and both of the bands are made of surgical tubing.

10. A bubble maker according to claim 1 wherein both of the bands are flexible and elastic and stretch when the separating means separates the bands and both of the bands are made of fabric-covered elastic.

11. A bubble maker according to claim 1 wherein at least one of the bands comprises a pair of side-by-side strands.

12. A bubble maker according to claim 1 wherein each of the bands comprises a pair of side-by-side strands.

13. A bubble maker according to claim 1 wherein at least one of the bands comprises a pair of side-by-side strands that are twisted about each other.

14. A bubble maker according to claim 1 wherein each of the bands comprises a pair of side-by-side strands, the strands of each band being twisted about each other.

15. A bubble maker according to claim 1 further comprising a pair of retainers affixed to the bands near the first and second positions for ensuring that the bands form a loop and preventing the bands from separating at the first and second positions, the retainers thereby facilitating entry of the bands into the dispensing means and the collection means.

16. A bubble maker according to claim 1 wherein both of the bands are elastic, the support member is in the shape of a cross having a vertical member and a pair of horizontal arms, and the separating means comprises a pair of pulley means respectively connected to the arms in spaced-apart relation to the flexible bands and a pair of drawstrings having first ends engageable with the respective flexible bands substantially at mid portions thereof and passing through the respective pulley means, the drawstrings having second ends that are joined together so that they can be pulled as a unit by a user of the bubble maker, thereby separating the bands.

17. A bubble maker according to claim 1 wherein both of the bands are elastic, the support member is in the form of a loop, and the separating means comprises a pair of pulley means respectively connected to the loop in spaced-apart relation to the flexible bands and a pair of drawstrings having first ends engageable with the resective flexible bands substantially at mid portions thereof and passing through the respective pulley means, the drawstrings having second ends that are joined together so that they can be pulled as a unit by a user of the bubble maker, thereby separating the bands.

18. A bubble maker according to claim 17 wherein the loop member comprises a plurality of mating arcuate portions.

19. A bubble maker according to claim 1 wherein the pump means comprises a pump insertable in the collection means and a pump line extending through the support means from the pump means to the dispensing means for returning to the dispensing means the bubble-forming solution pumped by the pump means.

20. A bubble maker comprising:

support means;

a pair of separate flexible and elastic bands connected to the support means at first and second spaced apart positions, the bands being adapted to extend substantially parallel and near to each other and being adapted to be flexed and stretched so as to form a gap of substantial size between the bands;

means for applying bubble-forming solution to the bands; and separating means mounted on the support means and engageable with the flexible bands at position intermediate the first and second positions for separating the bands;

whereby when solution is dispensed onto the bands, the bands are separated by the separating means, and a gentle air current is established relative to the bubble maker so that air passes between the separated bands, the solution forms a bubble.

21. A bubble maker comprising, in combination:

a) a support;

b) means mounted on said support for forming bubbles, said bubble forming means comprising at least two bands connected to said support at first and second spaced apart positions, said bands being generally parallel but separable intermediate said first and second positions and at least one of said bands being flexible and adapted to be flexed away from at least one other of said bands so as to form a gap therebetween;

c) means for dispensing bubble-forming solution onto said bubble forming means adjacent said first position; and, d) means for collecting excess bubble-forming solution draining from said bubble forming means adjacent said second position and returning said excess bubble-forming solution to said dispensing means; whereby, when said bubble maker is oriented with said first position above said second position, bubble-forming solution dispensed onto said bubble forming means by said dispensing means moves downwardly along said bands toward said second position under the influence of gravity so that when said at least one flexible band is flexed away from at least one other of said bands to form a gap therebetween, said bubble-forming solution on said bands spans said gap and is adapted to be stripped from said bands to form a bubble by air movement through said gap.

* * * * *